US009662879B2

(12) United States Patent
Stoeckle et al.

(10) Patent No.: US 9,662,879 B2
(45) Date of Patent: May 30, 2017

(54) METHOD TO IMPROVE THE SYSTEM STABILITY OF INKJET PRINTING SYSTEMS

(71) Applicant: Oce Printing Systems GmbH & Co. KG, Poing (DE)

(72) Inventors: Ulrich Stoeckle, Munich (DE); Harald Myllek, Munich (DE); Philippe Koerner, Forstinning (DE); Werner Zollner, Eitting (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/060,954

(22) Filed: Mar. 4, 2016

(65) Prior Publication Data

US 2016/0257112 A1 Sep. 8, 2016

(30) Foreign Application Priority Data

Mar. 4, 2015 (DE) ..... 10 2015 103 102

(51) Int. Cl.
*B41J 2/045* (2006.01)

(52) U.S. Cl.
CPC ..... *B41J 2/04581* (2013.01); *B41J 2/04593* (2013.01); *B41J 2/04596* (2013.01); *B41J 2202/21* (2013.01)

(58) Field of Classification Search
CPC B41J 2/04535; B41J 2/04586; B41J 2/04581; B41J 2/04593; B41J 2/04596; B41J 2202/21
See application file for complete search history.

(56) References Cited

U.S. PATENT DOCUMENTS

| | | | | |
|---|---|---|---|---|
| 6,715,852 | B2 | 4/2004 | Yonekubo | |
| 6,758,544 | B2 | 7/2004 | Fukano | |
| 9,120,306 | B2 | 9/2015 | Buschmann | |
| 2001/0050696 | A1* | 12/2001 | Suzuki | B41J 2/04588 347/27 |
| 2002/0171704 | A1 | 11/2002 | Yonekubo et al. | |
| 2010/0328385 | A1* | 12/2010 | Shibata | B41J 2/2125 347/12 |
| 2011/0242160 | A1* | 10/2011 | Tamada | B41J 2/16526 347/9 |

FOREIGN PATENT DOCUMENTS

| | | | |
|---|---|---|---|
| DE | 60125265 | T2 | 7/2007 |
| DE | 60213701 | T2 | 9/2007 |
| DE | 102012110187 | A1 | 4/2014 |

* cited by examiner

*Primary Examiner* — Stephen Meier
*Assistant Examiner* — Alexander D Shenderov
(74) *Attorney, Agent, or Firm* — Schiff Hardin LLP

(57) ABSTRACT

A method for stabilizing a print quality in an inkjet printing system is described. The inkjet printing system can include a nozzle arrangement that may be activated with a number of control signals that can be used to fire ink droplets with corresponding different droplet sizes onto a recording medium. In the method for stabilizing a print quality in an inkjet printing system, a rastered image for an image template can be created. The rastered image can be printable by the inkjet printing system using a subset of the different droplet sizes. Further, the nozzle arrangement can be activated with a control signal for an unused droplet size of the different droplet sizes to induce the nozzle arrangement to generate a prefire pulse.

18 Claims, 3 Drawing Sheets

METHOD TO IMPROVE THE SYSTEM STABILITY OF INKJET PRINTING SYSTEMS

CROSS REFERENCE TO RELATED APPLICATIONS

This patent application claims the benefit of German Patent Application No. 102015103102.7, filed Mar. 4, 2015, which is incorporated herein by reference in its entirety.

BACKGROUND

The embodiments described herein generally relate to devices and corresponding methods to stabilize the print quality of an inkjet printing system, including stabilizing the print quality when using inks with a high color density.

Inkjet printing systems may be used to print to recording media (such as paper, for example). For this, a plurality of nozzles may be used in order to fire or push ink droplets onto the recording medium, and thus in order to generate a desired print image on the recording medium.

During printing, print quality problems (for example an incorrect positioning of an ink droplet or a nozzle failure) may occur depending on the type of ink that is used and/or depending on the print speed and/or depending on the ejected droplet size per nozzle. These print quality problems typically arise due to the increase of the viscosity of the ink in the nozzle and/or due to waveforms for the drop generation that are not optimally adapted to the type or to the properties of the ink that is used. The waveform for activation of a nozzle or of a nozzle arrangement that is used for the ejection of an ink droplet typically depends on the properties of the ink and on the print speed. For specific combinations of inks/print speeds, it may be problematic to provide waveforms for different droplet sizes that lead to reproducible results over the duration of the printing operation.

The present document deals with the technical object to provide inkjet printing systems that deliver a print quality that is high and stable over an optimally long time period given use of different combinations of inks/print speeds.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
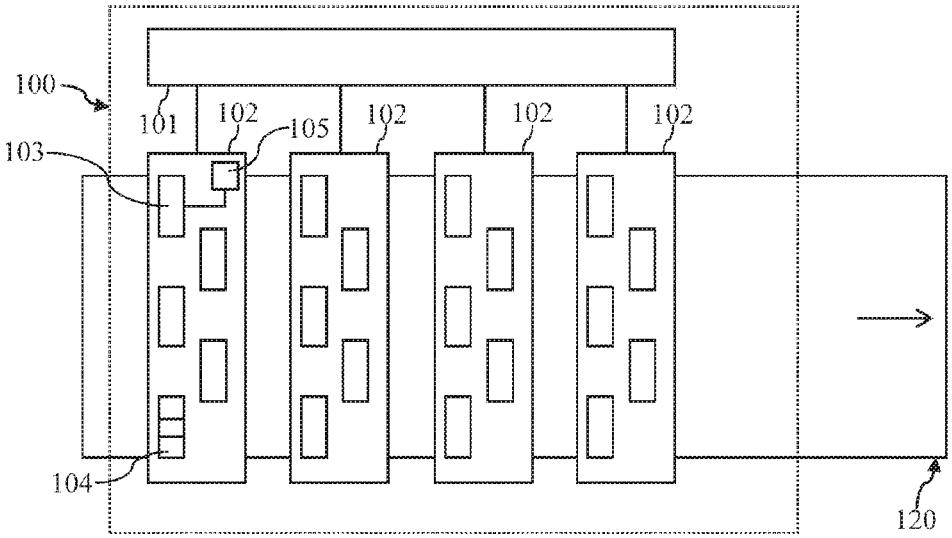
FIG. 1 illustrates a block diagram of an example of an inkjet printing system according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

According to one aspect, a method is described for stabilization of the print quality in an inkjet printing system. The inkjet printing system comprises a nozzle arrangement that may be activated with a limited number M of control signals in order to fire ink droplets with accordingly M different droplet sizes towards a recording medium. M is thereby typically greater than 1 (for example M=3). The method includes the creation of a rastered image for an image template that should be printed by the inkjet printing system using a subset of the M different droplet sizes, i.e. using fewer than M droplet sizes. Moreover, the method includes the activation of the nozzle arrangement with a control signal for an unused droplet size of the M droplet sizes in order to induce the nozzle arrangement to generate a prefire pulse (also designated as a service pulse).

According to a further aspect, a method is described for stabilization of the print quality in an inkjet printing system. The inkjet printing system comprises a nozzle arrangement that may be activated in order to generate a prefire pulse or in order to fire ink droplets with one or more different droplet sizes towards a recording medium. The method includes the creation of a rastered image for an image template that should be printed by the inkjet printing system. Moreover, the method includes the determination—on the basis of the rastered image—of a dead time between two ink droplets that directly follow one another chronologically, which ink droplets should be fired from the nozzle arrangement to print the rastered image. Furthermore, the method includes the determination—on the basis of the dead time—of whether the nozzle arrangement should generate a prefire pulse or not during the dead time. If it is determined that the nozzle arrangement should generate a prefire pulse during the dead time, the rastered image may be modified in order to induce the nozzle arrangement to generate one or more prefire pulses during the dead time.

According to a further aspect, a controller (which includes processor circuitry) is described that is set up to execute a method described in this document.

According to a further aspect, an inkjet printing system is described that comprises a controller described in this document.

FIG. 1 shows a block diagram of an example of an inkjet printing system 100 according to an exemplary embodiment of the present disclosure. The printing system 100 presented in FIG. 1 is designed for printing to a web-shaped recording medium 120 (also designated as a "continuous feed"). However, the aspects described in this document are also applicable to printing systems 100 that are set up in order to print to sheet-shaped recording media 120. A web-shaped recording medium 120 is typically unspooled from a roll (the take-off) and then supplied to the print group of the printing system 100. A print image is applied to the recording medium 120 via the print group, and after fixing/drying of the print image the printed recording medium 120 is taken up again on an additional roll (the take-up) again or cut into sheets. In FIG. 1, the movement direction of the recording medium 120 is represented by an arrow. The recording medium 120 may be produced from paper, paperboard, cardboard, metal, plastic, textiles and/or other suitable and printable materials.

In the depicted example, the print group of the printing system 100 comprises four print head arrangements 102 (that are also respectively designated as print bars). The different print head arrangements 102 may be used for printing with inks of different colors (for example black, cyan, magenta and/or yellow). The print group may comprise still further print head arrangements 102 for printing with additional colors or additional inks (for example, Magnetic Ink Character Recognition (MICR) ink).

A print head arrangement 102 comprises one or more print heads 103. In the shown example, a print head arrangement 102 comprises five respective print heads 103. Each print head 103 may in turn be subdivided into a plurality of print head segments 104, wherein each print head segment 104 typically comprises a plurality of nozzles or, respectively, nozzle arrangements.

A fitting position/orientation of a print head 103 within a print head arrangement 102 may depend on the type of print head 103. Each print head 103 comprises multiple nozzles or nozzle arrangements that may be arranged in different segments 104, wherein each nozzle is set up to fire or spray ink droplets onto the recording medium 120. For example, a print head 103 may comprise 2558 effectively utilized nozzles that are arranged along one or more rows transversal to the travel direction of the recording medium 120. The nozzles in the individual rows may be arranged offset from one another. A respective line on the recording medium 120 may be printed transversal to the travel direction by means of the nozzles of a print head 103. An increased resolution may be provided via the use of a plurality of rows with (transversally offset) nozzles. In total, 12790 droplets may thus be sprayed onto the recording medium 120 along a transversal line by a print head arrangement 102 depicted in FIG. 1. Each print head arrangement 100 may thus be set up to print a transversal line of a defined color on the recording medium 120 at a defined point in time.

The printing system 100 furthermore comprises a controller 101 (for example an activation hardware and/or a controller) that may be configured to activate the actuators of the individual nozzle arrangements of the individual print heads 103 in order to apply a print image onto the recording medium 120 depending on print data. In an exemplary embodiment, the controller 101 includes processor circuitry that is configured to perform one or more operations of the controller 101, including, for example, activating the actuators of the individual nozzle arrangements of the individual print heads 103 in order to apply a print image onto the recording medium 120 depending on print data.

Figure 2:
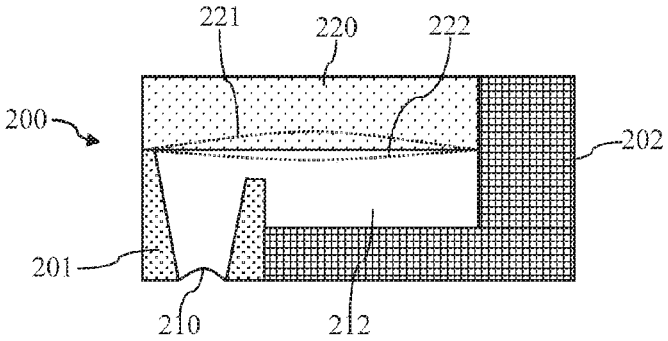
FIG. 2 illustrates a schematic design of an inkjet nozzle arrangement according to an exemplary embodiment of the present disclosure.

FIG. 2 shows an example design of a nozzle arrangement 200 of a print head 103 according to an exemplary embodiment of the present disclosure. In an exemplary embodiment, the nozzle arrangement 200 comprises walls 202 which, together with an actuator 220 and a nozzle 201, form a receptacle or chamber 212 to receive ink. An ink droplet may be sprayed onto the recording medium 120 via the nozzle 201 of the nozzle arrangement 200. The ink forms what is known as a meniscus 210 at the nozzle 201. Furthermore, the nozzle arrangement 200 comprises an actuator 220 (for example a piezoelectric element) that is set up to vary the volume of the chamber 212 to receive ink or, respectively, to vary the pressure in the chamber 212 of the nozzle arrangement 200. In particular, the volume of the chamber 212 may be reduced and the pressure in the chamber 212 increased by the actuator 220 as a result of a deflection 222, and thus an ink droplet may be pushed out of the nozzle arrangement 200 via the nozzle 201. FIG. 2 shows a corresponding deflection 222 of the actuator 220 (dotted line). Moreover, the volume of the chamber 212 may be increased via the actuator 220 (see deflection 221) in order to draw new ink into the receptacle or chamber 212 via an inlet.

The ink 212 within the nozzle arrangement 200 may thus be moved, and the chamber 212 may be put under pressure, via a deflection 221, 222 of the actuator 220. A defined movement of the actuator 220 thereby produces a correspondingly defined movement of the ink. The defined movement of the actuator 220 is typically produced via a corresponding waveform or a corresponding specific pulse of an activation signal of the actuator 220. In particular, via a fire pulse to activate the actuator 220 it may be produced that the nozzle arrangement 200 ejects an ink droplet via the nozzle 201. Different ink droplets may be ejected via different activation signals to the actuator 220. In particular, the ink droplets may thus be ejected with different droplet size (for example 5 pl, 7 pl or 12 pl). Furthermore via a prefire pulse for activation of the actuator 220 it may be brought about that, although the nozzle arrangement 200 produces a movement of the ink and an oscillation of the meniscus 210, no ink droplet is thereby ejected via the nozzle 201.

In an exemplary embodiment, the controller 101 of the printing system 100 can be configured to determine a waveform or a pulse for each pixel of a print image that is to be printed, with which waveform or pulse the actuator 220 of the nozzle arrangement 200 should be activated in order to produce an ink firing from the nozzle 201 and in order to thus print a pixel on the recording medium 120. The waveform for the pixel to be printed may include a fire pulse via which the ink firing is produced. For example, the waveform may depend on the color and/or the color brightness of the pixel to be printed. For the printing of continuous tones, different droplet sizes (for example 5 pl, 7 pl or 12 pl) may be used depending on brightness. The ejection of ink droplets of different droplet sizes may be produced via different waveforms (for example via fire pulses of different strength, or of modified fire pulses) of the actuator 220. Furthermore, the waveform may depend on the print speed and/or on the properties (for example on the viscosity) of the ink.

As presented above, in specific situations—in particular given the use of inks with a relatively high viscosity and/or at relatively low print speeds—it may be problematic to determine waveforms for the ink ejection that may ensure a high print quality over a long time period. In particular, incorrect positioning of ink droplets and/or nozzle failures may occur in such situations.

The reduction of print quality may typically be ascribed to an increase of the viscosity of the ink within individual nozzle arrangements 200 due to evaporation effects. One possibility in order to counteract such an increase in viscosity is the printing of non-imaging information, for example the printing of refresh dots and/or of refresh lines. Refresh dots thereby comprise additional ink droplets that are printed in the background of a print image such that the print image is only slightly negatively affected by this. Refresh lines comprise one or more dedicated printed lines that must be cut out at the end of the printing process. These measures thus lead to an increased consumption of printing materials (such as ink and/or paper).

An additional possibility in order to counteract an increase in viscosity of the ink is the use of prefire pulses. Via a prefire pulse, the actuator 220 of a nozzle arrangement 200 is induced to move the ink within the nozzle arrangement 200, and to bring the meniscus 210 at the nozzle 201 into oscillation, such that, although a mixing of the ink within the chamber 212 of the nozzle arrangement 200 occurs, an ejection of ink does not. A prefire pulse thus enables the viscosity of the ink within the nozzle arrangement 200 to be reduced without printing a "non-white" pixel.

For every individual nozzle arrangement 200 of the printing system 100, the controller 101 may be set up to determine—on the basis of the print data (in particular on the basis of a rastered image)—whether a "white" pixel or a "non-white" pixel should be printed at a specific point in time. If it is determined that a "non-white" pixel should be printed at the specific point in time, the controller 101 may determine the droplet size to be printed on the basis of the print data. If it is determined that a "white" pixel should be printed at the specific point in time, the controller 101 may thus determine (on the basis of the print data) whether a prefire pulse should take place at the specific point in time in order to reduce the viscosity of the ink in the nozzle arrangement 200. It is thereby typically advantageous to keep the number of prefire pulses as low as possible in order to reduce a loading of and the danger of overheating the nozzle arrangement 200.

For a specific pixel of a rastered image, it may thus be determined whether a) a droplet of a specific size should be ejected from the nozzle arrangement 200 (in order to print a "non-white" pixel);

b) the actuator 220 of the nozzle arrangement 200 should be activated with a prefire pulse (in order to print a "white" pixel, and in order to reduce the viscosity of the ink in the nozzle arrangement); or c) no activation of the actuator 220 of the nozzle arrangement 200 should take place (in order to "print" a "white" pixel).

In an exemplary embodiment, this information may be transmitted from the controller 101 to a controller 105 of the print bar 102 in encoded form (for example as an N-bit value, wherein N=2, for example), in which print bar 102 the activated nozzle arrangement 200 is located. In an exemplary embodiment, the controller 105 is configured to select a suitable waveform for activation of the actuator 220 of the nozzle arrangement 200 depending on the received information, and activate the actuator 220 according to the selected waveform. In an exemplary embodiment, the controller 105 includes processor circuitry configured to perform one or more operations of the controller 105, including, for example, the selection of the suitable waveform and the activation of the actuator 220.

Figure 3:
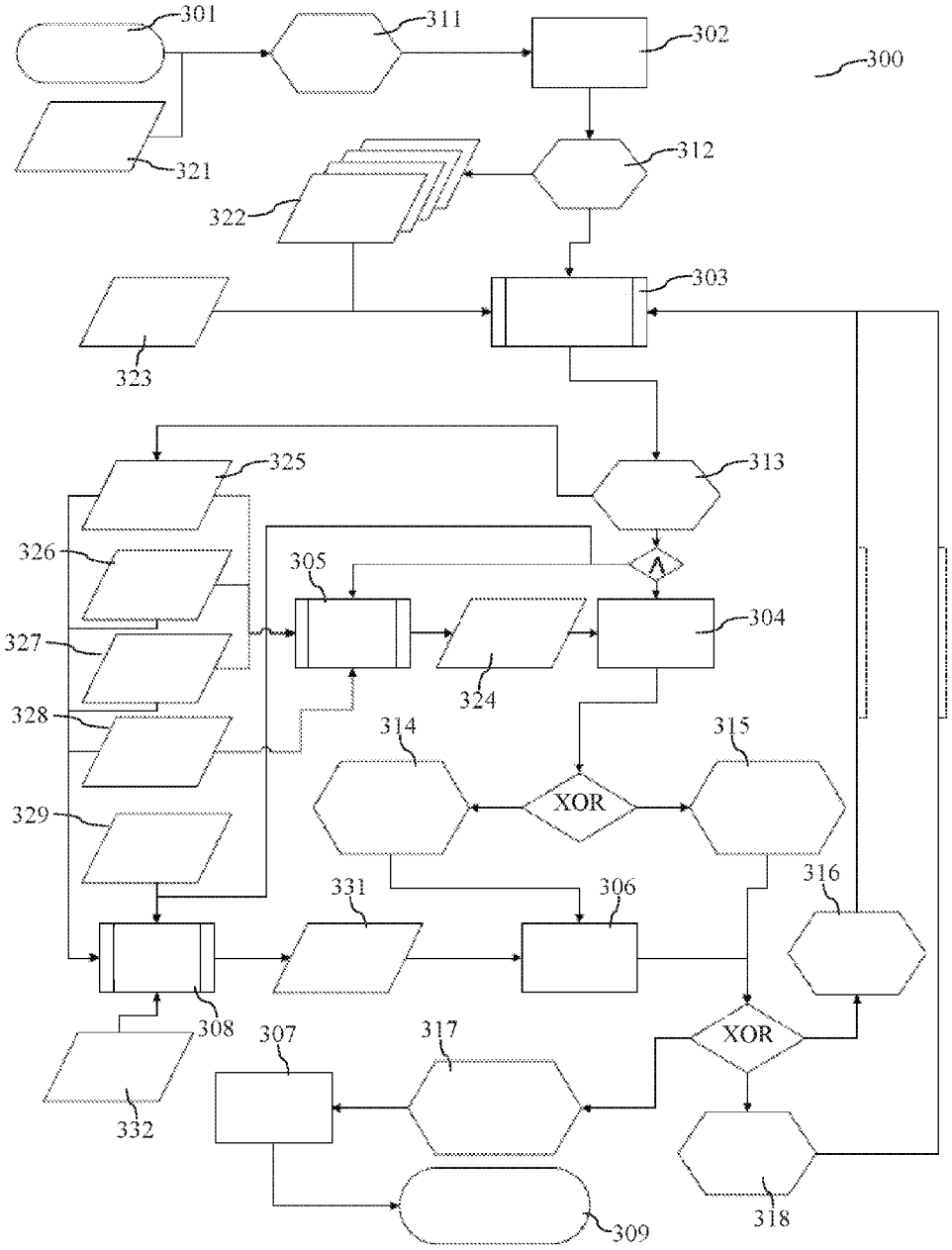
FIG. 3 illustrates a workflow diagram of an example of a method for stabilization of the print quality of an inkjet printing system according to an exemplary embodiment of the present disclosure.

FIG. 3 shows a workflow diagram of a method 300 to stabilize the print quality of an inkjet printing system 100. In particular, the method 300 is designed to determine a number of prefire pulses that should be used for a nozzle arrangement 200 upon printing of a print image in order to stably keep the print quality of the nozzle arrangement 200 at a high level. The method 300 may be executed by the controller 101, for example.

The processing of an image 321 to be printed begins in step 301, and the method 300 thereupon has the status 311, "Data processing has begun." The image 321 to be printed may already be present in a rastered form, meaning that the image 321 to be printed may comprise a plurality of pixels (for example a matrix of pixels), wherein each pixel is printed in a print bar 102 of the printing system 100 via precisely one nozzle arrangement 200 of the inkjet printing system 100. In other words: the rastered image 321 comprises a plurality of pixels, wherein each pixel includes control instructions (for example in the aforementioned encoded form) for respectively precisely one nozzle arrangement 200 of a print bar 102 of the printing system 100. In particular, the pixels of a line of the rastered image 321 are printed by the corresponding nozzle arrangements 200 of a print bar 102. This process repeats for the following lines of the rastered image 321. The pixels of a specific column of the rastered image 321 are thereby printed by a specific nozzle arrangement 200 of a specific print bar 102. Each pixel typically includes control instructions for a plurality of print bars 102 of the printing system 100 that are used. The rastered image 321 may have been created in a rastering and screening process on the basis of an image template (a PDF file, for example) to be printed.

The image 321 typically comprises a plurality of image layers 322, wherein each image layer 322 is typically printed by a different print bar 102 of the printing system 100. For example, the different image layers 322 may correspond to different color components of the image 321. In step 302, the image 321 is divided up into one or more image layers 322 so that the method 300 thereupon has the status 312, "Print image divided up." An image layer 322 then comprises the control instructions for the nozzle arrangements 200 of a print bar 102 of the printing system 100.

For a nozzle device 200 of a print bar 102 of the printing system 100, the method 300 additionally includes the determination 303 of a dead time 325—NPT (Non-Printing Time)—between two successive "non-white" pixels to be printed. The dead time NPT 325 is determined on the basis of the print data of the image layer 322 for the print bar 102. As presented above, the image layer 322 may comprise a matrix of pixels to be printed, wherein each column of the matrix is to be printed by a respective nozzle device 200 of the print bar 102. The dead time NPT 325 can thus be determined on the basis of the column of the matrix that should be printed by the respective nozzle device 200. Furthermore, the dead time 325 depends on the print speed 323. In particular, the dead time NPT 325 is typically inversely proportional to the print speed 323. After determination of the dead time NPT 325, the method 300 is in the "NPT determined" state 313.

If a dead time NPT 325 between two "non-white" pixels to be printed that reaches or exceeds a specific dead time threshold 324 has been determined for a nozzle arrangement 200, this may lead to a viscosity increase of the ink within the nozzle arrangement 200, due to which a reduction of the print quality may be caused. The dead time threshold 324 may thereby depend on the plurality of factors. The method 300 therefore includes a step 305 to determine the dead time threshold 324. The dead time threshold 324 may in particular depend on the ink 326 that is used (in particular on a property of the ink 326 that is used), on a climatic condition 327 (for example on the temperature and/or the humidity) in the environment of the nozzle arrangement 200 and/or on a requirement 328 for the print quality (for example on an acceptable offset of pixels).

It may then be determined 304 whether the dead time NPT 325 is greater than or equal to the dead time threshold 324. If the dead time NPT 325 is less than or equal to the dead time threshold 324 (state 315), the image layer may 322 remain unchanged. In other words, in this case it may be arranged for that no activation of the nozzle arrangement 200 with a prefire pulse (as provided by the print data of the image layer 322) takes place during the dead time NPT 325.

If it is determined that the dead time NPT 325 is greater than the dead time threshold 324 (state 314), it may be arranged for that the nozzle arrangement 200 is charged with one or more prefire pulses during the dead time NPT 325 (step 306). In other words, a prefire pulse sequence for the dead time NPT 325 may be inserted into the print data of the image layer 322. It may thus be achieved that the viscosity of the ink in the nozzle arrangement 200 is sufficiently reduced so that a high print quality is maintained, even given a (chronologically speaking) relatively long non-use of the nozzle arrangement 200.

The prefire pulse sequence that is inserted between two successive "non-white" pixels to be printed (if the dead time NPT 325 is greater than the dead time threshold 324) may be described by a plurality of prefire parameters 331. The prefire parameters 331 include one or more of:

- a number of prefire pulses in the prefire pulse sequence; and/or
- a chronological placement of the one or more prefire pulses during the dead time NPT 325.

The method 300 includes the determination 308 of the prefire parameters 331. The prefire parameters 331 may be determined depending on a plurality of state data, for example depending on the ink 326 that is used (in particular on the property of the ink 326 that is used), on a climatic condition 327 (for example on the temperature and/or the humidity) in the environment of the nozzle arrangement 200, on the dead time NPT 325 and/or on a requirement 328 for the print quality (for example on an acceptable offset of pixels). Furthermore, predefined rules 329, 332 with regard to the prefire parameters 331 (for example in the form of lookup tables) may be used in order to determine the prefire parameters 331 (and therefore the prefire pulse sequence). The predefined rules 329, 332 may associate different prefire parameters 331 with different combinations of state data. The predefined rules 329, 332 may be determined experimentally, for example.

The prefire pulse sequence corresponding to the prefire parameters 331 is inserted into the print data of the image layer 322 (step 306), such that the nozzle arrangement 200 is charged with one or more prefire pulses according to the prefire pulse sequence between the successive "non-white" pixels. This method 300 may be implemented for all nozzle arrangements 200 of a print bar 102 (state 316) and for all image layers 322, i.e. for all print bars 102 that are used (state 318). If the print data for all print bars 102 and all nozzle arrangements 200 have been processed (state 317), the (modified) image layers 322 may be combined with one another again (step 307) and the processing of the print data may be concluded (step 309).

The controller 101 transmits the print data for a (modified) image layer 322 to the controller 105 of the corresponding print bar 102. For each pixel, the print data of the image layer 322 indicate whether a droplet ejection should take place, and if applicable in which droplet size a droplet ejection should take place. If no droplet ejection should take place for a pixel, the print data show whether the corresponding nozzle arrangement 200 should be activated with a prefire pulse or not.

In an example printing system 100, the number of bits of the print data (which may be transmitted from the controller 101 to the controller 105 for each pixel) may be limited to N control bits (for example N=2). In other words: the number of control signals that may be transferred from the controller 101 to the controller 105 per pixel may be limited. With 2 control bits, for example, it may be indicated whether

- no droplet ejection should take place ("white" pixel);
- a droplet ejection should take place with 7 pl;
- a droplet ejection should take place with 9 pl; or
- a droplet ejection should take place with 12 pl.

In order to enable the controller 101 to indicate to the controller 105 that a prefire pulse should take place without the number of transferred control bits/pixels being thereby increased, a reassignment of the available N (for example 2) control bits may take place. For example, the instruction "droplet ejection with 7 pl) may be replaced with the instruction "prefire pulse", such that with 2 control bits it may be indicated whether

- no droplet ejection should take place ("white" pixel);
- a prefire pulse should take place;
- a droplet ejection should take place with 9 pl; or
- a droplet ejection should take place with 12 pl.

Alternatively, a different droplet size (for example 12 pl or 9 pl) may be used for the instruction to generate a prefire pulse.

Within the scope of the rastering of an image template to be printed, the image template to be printed is divided up into a plurality of template layers, wherein each template layer corresponds to a different color that is printed by a different print bar 102 of the printing system 100. The individual template layers typically include regions with different inking levels of the respective color (for example inking levels from 0% to 100%). In order to be able to print the regions with different inking levels, different distributions—in particular different densities—of ink droplets and/or different droplet sizes are typically used. Within the scope of the rastering, a region of a template layer with a defined inking level may be transformed into a corresponding region of the rastered image layer 322 using what are known as screening sets or, respectively, screens, wherein the region of the image layer 322 includes a plurality of image points or pixels that indicate whether and possibly in what size an ink droplet should be printed at the respective image points.

The reduction of the number of available droplet sizes as described above thus typically requires a modified rastering of an image template which should be printed by the printing system 100. In particular, different screening sets or, respectively, screens which take into account that only a limited number of droplet sizes is available (for example that the 7 pl droplet size is not available) are used for the determination of an image layer 322 from a template layer. A reduction of the print image quality due to the reduced number of available droplet sizes may be at least partially avoided via the consideration of the reduced number of droplet sizes in the rastering of the image templates to be printed. On the other hand, the reduction of the print image quality may be limited via the modified rastering of the image template with adapted screens.

The rastered images 321 used in method 300 may be rastered or, respectively, may have been re-rastered under consideration of the reduced number of droplet sizes. The controller 101 may thus be enabled to transmit the "prefire pulse" instruction to the controller 105 within the scope of the available number N of control bits. In other words, a stable print quality may be achieved.

Given a typical rastering/screening method, an image template to be printed with M=3 different droplet sizes (for example 5 pl, 7 pl, 12 pl) may thus be prepared. Given the rastering method described in this document, in a deviation from this an image template to be printed may be prepared with only (M−1) different droplet sizes (for example 5 pl, 12 pl), such that one droplet size remains unused and is available for control signals with regard to a prefire pulse. The number of imaging droplet sizes is thus reduced via the modified rastering method, such that a reduced number of stable waveforms for the ejection of the reduced number of imaging droplet sizes may be used in order to generate the print image on the recording medium 120. The screening process and the rastering may thereby be modified such that the print quality—i.e. the reproduction of the image template to be printed—is not (substantially) reduced with regard to tonal value scale and detail sharpness.

Via the reduction of the imaging droplet sizes, the possibility is thus achieved to integrate a non-imaging maintenance pulse (i.e. a prefire pulse) into the rastered image given an unmodified data set. The integration of one or more prefire pulses into the print data may take place with the method 300 depicted in FIG. 3. The method 300 determines the necessary number and/or placement of prefire pulses depending on the non-printing time (NPT or, respectively, dead time) 325 and inserts this into the image 321.

Figure 4:
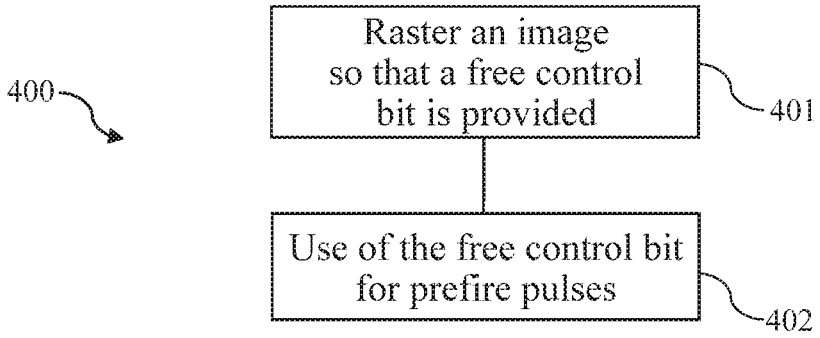
FIG. 4 illustrates a workflow diagram of an example of a method for providing prefire pulses in an inkjet printing system according to an exemplary embodiment of the present disclosure.

FIG. 4 shows a workflow diagram of an example of a method 400 for stabilization of the print quality in an inkjet printing system 100. The inkjet printing system 100 comprises (at least) a nozzle arrangement 200 that may be activated with a limited number M of control signals in order to fire or eject ink droplets with corresponding M different droplet sizes onto a recording medium 120. In other words, the inkjet printing system 100 is set up such that the ejection of ink droplets with M different droplet sizes may be produced using M different control signals. This means that the M different control signals may be used by the printing system 100 in order to induce a nozzle arrangement 200 of the printing system 100 to eject ink droplets with M different droplet sizes. The inkjet printing system 100 typically comprises a plurality of nozzle arrangements 100 that are arranged in a print bar 102, and that are set up to print a line of a rastered image 321 or to print rastered print data.

The nozzle arrangement 200 or the print bar 102 thus has a limitation to the effect that only M control signals may be used for the activation of a nozzle arrangement 200 (for example due to a limitation of the transfer rate or of the transfer protocol between a controller 101 of the inkjet printing system 100 and a controller 105 of the print bar 102 or of the nozzle arrangement 200). For example, the nozzle arrangement 200 and/or the print bar 102 may be limited such that the nozzle arrangement 200 may be activated with only M=3 control signals in order to fire or eject ink droplets with accordingly M different droplet sizes onto the recording medium 120. The M droplet sizes may include droplet sizes that are greater than 0 pl (picoliter), for example a droplet size of 7 pl, a droplet size of 9 pl and/or a droplet size of 12 pl. The M control signals may be encoded with a predetermined number N of control bits. The nozzle arrangement 200 typically may be controlled with an additional control signal in order to "print" a "white" pixel on the recording medium 120, i.e. to produce no droplet ejection for an image point of a rastered image 321. In particular, with a specific combination of control bits the nozzle arrangement 200 may be informed that no droplet ejection should take place at a specific point in time.

For example, control signals for printing a line of the rastered image 321 at the nozzle arrangements 200 may be transmitted to a print bar 102 with a specific frequency. The frequency with which control signals are transmitted to the nozzle arrangements 200 thereby depends on the print speed (i.e. on the number of printed lines per time unit). For each line, the control signals may indicate to the individual nozzle arrangements 200 whether an image point should be printed, and possibly with what droplet size the image point should be printed. Given use of M different droplet sizes, for each nozzle arrangement 200 this information may be communicated via one of M+1 different control signals (for example via one of M+1 predefined combinations of control bits). For each line of the rastered image 321, a specific control signal (for example a specific combination of control bits) per nozzle arrangement 200 may be sent to the respective nozzle arrangement 200. The number of different control signals (for example the number of different combinations of control bits) that may be transmitted to a nozzle arrangement 200 for a line may thereby be limited to M+1.

The method 400 includes the creation 401 of a rastered image 321 or of rastered image data for an image template that should be printed by the inkjet printing system 100. The rastered image 321 is thereby created using a subset of the M different droplet sizes. In other words, not all droplet sizes which could in principle be fired from the nozzle arrangement are considered in the rastering and/or screening. A negative effect on the print quality provided by the inkjet printing system 100 may be reduced via the consideration of a reduced number of available droplet sizes directly in the creation of the rastered image 321.

The method 400 additionally includes the activation 402 of the nozzle arrangement 200 with a control signal for an unused droplet size of the M droplet sizes in order to induce the nozzle arrangement 200 to generate a prefire pulse. For example, the unused droplet size may correspond to the smallest droplet size or a middle droplet size (for example 7 pl) of the M droplet sizes.

Via the reduction of the number of droplet sizes that are used, at least one control signal is available which is not used for the printing of the rastered image 321. This control signal may now be used to generate one or more prefire pulses with the nozzle arrangement 200 as needed. Given a prefire pulse, an ink meniscus 210 is typically set into oscillation at a nozzle 201 of the nozzle arrangement 200, and no ejection of ink 326 from the nozzle arrangement 200 takes place. A reduction of the viscosity of the ink 326 within the nozzle arrangement 200 may be counteracted via a prefire pulse, and thus a uniform (i.e. stable) high print quality may be ensured.

The method may additionally include the determination 303—on the basis of the rastered image 321—of a dead time 325 between two ink droplets in direct chronological succession, which ink droplets should be fired or ejected from the nozzle arrangement 200 to print the rastered image 321. The dead time 325 is thereby typically already determined in advance, i.e. before the ejection of the two ink droplets in direct chronological succession via the nozzle arrangement 200. Moreover, the method 400 includes the determination 304—on the basis of the dead time 325—of whether the nozzle arrangement 200 should generate one or more prefire pulses or not during the dead time 325.

If it is determined that the nozzle arrangement 200 should generate one or more prefire pulses during the dead time 325, the nozzle arrangement 200 may be activated with the available control signal during the printing of the rastered image 321 in order to print the one or more prefire pulses between the two ink droplets in direct chronological succession, i.e. during the dead time 325, i.e. in order to print "white" pixels with excitation of the ink meniscus 210. On the other hand, if it is determined that the nozzle arrangement 200 should generate no prefire pulse during the dead time 325, the nozzle arrangement 200 may be activated between the two ink droplets in direct chronological succession in order to print "white" pixels without excitation of the ink meniscus 210 of the nozzle arrangement 200. In particular, a control signal may be transmitted to the nozzle arrangement 200, via which it is indicated that no pixel should be printed in a specific line of the rastered image 321.

Via the determination of the dead time 325, it may be ensured that prefire pulses are only generated as needed, and the nozzle arrangement 200 may otherwise recover. An overheating of the nozzle arrangement 200 may thus be avoided.

The method may additionally include the determination 305 of a dead time threshold 324. The dead time threshold 324 may, for example, be determined depending on one or more of the following state data: a property of the ink 326 used by the nozzle arrangement 200; a climatic condition 327 in an environment of the nozzle arrangement 200; and/or a requirement 328 for the print quality of the inkjet printing system.

The determination 304 may include the comparison of the dead time 325 with the dead time threshold 324. It may then be determined that the nozzle arrangement 200 should generate one or more prefire pulses during the dead time 325 if the dead time 325 is greater than the dead time threshold 324.

The method 400 may additionally include the determination 308 of one or more prefire parameters 331, wherein the one or more prefire parameters 331 indicates a number and/or a time distribution of prefire pulses that should be generated by the nozzle arrangement 200 during the dead time 325. The one or more prefire parameters 331 may be determined depending on one or more of the following state data: a property of the ink 326 used by the nozzle arrangement 200; a climatic condition 327 in an environment of the nozzle arrangement 200; a requirement 328 for the print quality of the inkjet printing system 100; and/or the dead time 325 (in particular the duration of the dead time 325). The number and/or the distribution of prefire pulses to be generated may thus be adapted in order to achieve an optimally high degree of stabilization of the print quality.

The method 400 may additionally include the modification of an image point of the rastered image 321 or the modification of the rastered image data. The modification may be made in order to induce—by means of the modified image point—the nozzle arrangement to generate a prefire pulse upon printing of the image point. The modified image point is thereby an image point of the rastered image 321 that should be printed by the nozzle arrangement 200. Furthermore, the modified image point corresponds to the point in time at which the nozzle arrangement 200 should generate the prefire pulse, and the modified image point indicates that the nozzle arrangement should generate the prefire pulse. For example, the image point may include the control signal which induces the nozzle arrangement to generate a prefire pulse.

As discussed above, in an exemplary embodiment, the inkjet printing system 100 may comprise a plurality of nozzle arrangements 200. In an exemplary embodiment, for the plurality of nozzle arrangements 200, the control signal is used for the unused droplet size can be used in order to induce the respective nozzle arrangement 200 to generate a prefire pulse. Moreover, when a prefire pulse should be generated can be determined based on the rastered image 321 for one or more (e.g. each) nozzle arrangements 200 of the plurality of nozzle arrangements 200.

The aforementioned method for stabilization of the print quality in an inkjet printing system 100 may also be used for an inkjet printing system 100 that does not have the aforementioned limitation with regard to the number M of control signals for activation of a nozzle arrangement 200. In particular, the method may be applied to an inkjet printing system 100 which comprises (at least) a nozzle arrangement 200 that may be activated in order to generate a prefire pulse or in order to fire ink droplets with one or more different droplet sizes into a recording medium 120.

The method for stabilization of the print quality in an inkjet printing system 100 may in this case include the creation 401 of a rastered image 321 for an image template that should be printed by the inkjet printing system 100. Moreover, the method may include the determination 303—on the basis of the rastered image 321—of a dead time 325 between two ink droplets in direct chronological succession, which ink droplets should be fired or ejected by the nozzle arrangement 200 to print the rastered image 321. On the basis of the dead time 325, it may then be determined 304 whether the nozzle arrangement 200 should generate a prefire pulse during the dead time 325. If it is determined that the nozzle arrangement 200 should generate a prefire pulse during the dead time 325, the rastered image 321 may be modified at a corresponding image point in order to induce the nozzle arrangement 200 to generate a prefire pulse during the dead time 325. Via the selective insertion of one or more prefire pulses, the print quality may be stabilized over a longer duration, and at the same time a loading of the nozzle arrangement 200 may be minimized.

An increase of the stability of a printing system 100 with regard to the print quality and the reliability of the printing system 100 is achieved via the method described in this document. A maintenance pulse (i.e. a prefire pulse) may thereby also be used with bar driving boards (BDB) 105 that exhibit a limitation with regard to the number N of control bits. This enables the use of novel inks (for example inks with high color density that dry relatively quickly) in such limited print bars 102. Furthermore, the droplet positioning may be improved given rapidly drying inks or given inks with a relatively small operating window and/or a relatively low stability (for example a relatively low viscosity).

Moreover, the effort for the creation and testing of waveforms for the individual droplet sizes is reduced via a reduction of the number of droplet sizes to be printed. Print image flaws (in particular due to refresh dots) may be reduced via the use of non-imaging maintenance pulses. Moreover, the amount of ink consumed may be reduced via a reduced number of refresh dots.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

100 printing system
101 controller of the printing system 100
102 print head arrangement/print bar
103 print head
104 print head segment
105 controller of a print head arrangement
120 recording medium
200 nozzle arrangement
201 nozzle
202 wall
210 meniscus
212 chamber
220 actuator (piezoelectric element)
221, 222 deflection of the actuator
300 method to insert prefire pulses
301, 302, 303, 304, 305, 306, 307, 308, 309 method steps
311, 312, 313, 314, 315, 316, 317, 318 states
321 rastered image
322 image layer
323 print speed
324 dead time threshold
325 dead time
326 ink
327 climatic condition
328 requirement for print quality
329, 332 rules for determining prefire parameters
331 prefire parameter
400 method for stabilizing the print quality
401, 402 method steps

What is claimed is:

1. A method for stabilizing a print quality in an inkjet printing system including a nozzle arrangement that may be activated with a number M of control signals, M being greater than one and the M control signals being usable to fire ink droplets with corresponding M different droplet sizes onto a recording medium, the method comprising:

creating a rastered image for an image template, the rastered image being printable by the inkjet printing system using a subset of the M different droplet sizes;

reassigning a control signal for an unused droplet size of the M different droplet sizes as a prefire pulse control signal; and activating the nozzle arrangement with the prefire pulse control signal to induce the nozzle arrangement to generate a prefire pulse.

2. The method according to claim 1, further comprising:

determining, based on the rastered image, a dead time between two ink droplets in direct chronological succession to be fired from the nozzle arrangement to print the rastered image; and determining, based on the dead time, whether the nozzle arrangement should generate a prefire pulse during the dead time.

3. The method according to claim 2, further comprising determining a dead time threshold, wherein:

the determination of whether the nozzle arrangement should generate the prefire pulse during the dead time includes a comparison of the dead time with the dead time threshold, and it is determined that the nozzle arrangement should generate the prefire pulse during the dead time if the dead time is greater than the dead time threshold.

4. The method according to claim 3, further comprising:

determining one or more prefire parameters, the one or more prefire parameters being indicative of at least one of:

a number of prefire pulses that should be generated by the nozzle arrangement during the dead time, and a time distribution of prefire pulses that should be generated by the nozzle arrangement during the dead time.

5. The method according to claim 2, further comprising:

determining one or more prefire parameters, the one or more prefire parameters being indicative of at least one of:

a number of prefire pulses that should be generated by the nozzle arrangement during the dead time, and a time distribution of prefire pulses that should be generated by the nozzle arrangement during the dead time.

6. The method according to claim 5, wherein at least one of the one or more prefire parameters and the dead time threshold are determined based on state data, the state data including at least one of:

a property of ink used by the nozzle arrangement;

a climatic condition in an environment of the nozzle arrangement;

a requirement for the print quality of the inkjet printing system; and the dead time.

7. The method according to claim 2, wherein:

the inkjet printing system further comprises one or more other nozzle arrangements, the nozzle arrangement and the one or more other nozzle arrangements being arranged in a print bar and configured to print a line of the rastered image; and the control signal for the unused droplet size of the M different droplet sizes is used for the nozzle arrangement and the one or more other nozzle arrangements to induce each of the nozzle arrangement and the one or more other nozzle arrangements to generate a respective prefire pulse.

8. The method according to claim 2, further comprising modifying an image point of the rastered image, the image point being printable by the nozzle arrangement, wherein:

the image point corresponds to a point in time at which the nozzle arrangement should generate the prefire pulse; and the modified image point indicates that the nozzle arrangement should generate the prefire pulse.

9. The method according to claim 2, wherein at least one of:

M equals 3;

the M droplet sizes include at least one of a droplet size of 7 pl, a droplet size of 9 pl and a droplet size of 12 pl;

the unused droplet size corresponds to a smallest droplet size of the M droplet sizes; and the unused droplet size corresponds to a droplet size of 7 pl.

10. The method according to claim 2, wherein, in response to the prefire pulse being generated:

an ink meniscus at a nozzle of the nozzle arrangement is set into oscillation; and no ejection of ink from the nozzle arrangement occurs.

11. The method according to claim 1, wherein:

the inkjet printing system further comprises one or more other nozzle arrangements, the nozzle arrangement and the one or more other nozzle arrangements being arranged in a print bar and configured to print a line of the rastered image; and the control signal for the unused droplet size of the M different droplet sizes is used for the nozzle arrangement and the one or more other nozzle arrangements to induce each of the nozzle arrangement and the one or more other nozzle arrangements to generate a respective prefire pulse.

12. The method according to claim 1, further comprising modifying an image point of the rastered image, the image point being printable by the nozzle arrangement, wherein:

the image point corresponds to a point in time at which the nozzle arrangement should generate the prefire pulse; and the modified image point indicates that the nozzle arrangement should generate the prefire pulse.

13. The method according to claim 1, wherein at least one of:

M equals 3;

the M droplet sizes include at least one of a droplet size of 7 pl, a droplet size of 9 pl and a droplet size of 12 pl;

the unused droplet size corresponds to a smallest droplet size of the M droplet sizes; and the unused droplet size corresponds to a droplet size of 7 pl.

14. The method according to claim 1, wherein, in response to the prefire pulse being generated:

an ink meniscus at a nozzle of the nozzle arrangement is set into oscillation; and no ejection of ink from the nozzle arrangement occurs.

15. The method according to claim 1, wherein no ejection of ink from the nozzle arrangement occurs in response to the generated prefire pulse.

16. A method for stabilization of a print quality in an inkjet printing system including a nozzle arrangement that may be activated to generate a prefire pulse or to fire ink droplets with one or more different droplet sizes onto a recording medium, the method comprising:

creating a rastered image for an image template, the rastered image being printable by the inkjet printing system using a subset of control signals that control the inkjet printing system to fire ink droplets having corresponding ink droplet sizes onto the recording medium;

determining, based on the rastered image, a dead time between two ink droplets in direct chronological succession to be fired from the nozzle arrangement to print the rastered image;

determining, based on the dead time, whether the nozzle arrangement should generate a prefire pulse during the dead time; and if it is determined that the nozzle arrangement should generate the prefire pulse during the dead time, reassigning an unused control signal of the control signals for an unused ink droplet size as a prefire pulse control signal and inducing the nozzle arrangement to generate the prefire pulse during the dead time using the prefire pulse control signal.

17. A method for stabilizing a print quality in an inkjet printing system configured to fire ink droplets onto a recording medium, the method comprising:

identifying a plurality of control signals that respectively correspond to a different ink droplet size, each control signal of the plurality of control signals being configured to control the inkjet printing system to fire an ink droplet having the corresponding ink droplet size onto the recording medium;

determining an unused ink droplet size of the different ink droplet sizes to identify a subset of the plurality of control signals, the subset including a smaller number of control signals than the plurality of control signals; and reassigning a control signal of the plurality of control signals corresponding to the unused ink droplet size as a prefire pulse control signal configured to control the inkjet printing system to generate a prefire pulse.

18. The method according to claim 17, further comprising:

creating a rastered image that is printable by the inkjet printing system using the subset of the plurality of control signals; and controlling the inkjet printing system to:

fire one or more ink droplets onto the recording medium based on the rastered image using the subset of the plurality of control signals; and generate the prefire pulse based on the prefire pulse control signal.

* * * * *